United States Patent [19]

Heinze

[11] Patent Number: 4,457,239

[45] Date of Patent: Jul. 3, 1984

[54] SHELVING SYSTEM AND ITS PRODUCTION PROCEDURE

[76] Inventor: Bjarne C. Heinze, Hasselvej 15, 2740 Skovlunde, Denmark

[21] Appl. No.: 269,482

[22] Filed: Jun. 2, 1981

Related U.S. Application Data

[63] Continuation of Ser. No. 76,183, Sep. 17, 1979.

[30] Foreign Application Priority Data

Sep. 22, 1978 [DK] Denmark ..... 4201/78

[51] Int. Cl.[3] ..... A47B 9/00

[52] U.S. Cl. ..... 108/109; 108/111; 108/156

[58] Field of Search ..... 108/107, 109, 110, 111, 108/156; 211/191

[56] References Cited

U.S. PATENT DOCUMENTS

| | | | |
|---|---|---|---|
| 359,691 | 3/1887 | Reed | 108/114 |
| 1,630,492 | 5/1927 | Kusterle | 108/156 |
| 2,026,223 | 12/1935 | Donnelly et al. | 108/109 |
| 2,933,193 | 4/1960 | De Mattia | 108/156 |
| 3,100,574 | 8/1963 | Buechler | 211/191 |
| 3,269,338 | 8/1966 | Shewell | 108/109 |
| 3,757,967 | 9/1973 | Colbridge | 211/191 |
| 3,797,903 | 3/1974 | Traulsen | 108/110 |
| 3,932,047 | 1/1976 | Crossan | 108/156 X |

FOREIGN PATENT DOCUMENTS

| | | | |
|---|---|---|---|
| 454871 | 5/1913 | France | 108/110 |

*Primary Examiner*—Francis K. Zugel

*Attorney, Agent, or Firm*—Burgess, Ryan & Wayne

[57] ABSTRACT

A shelving system of the type consisting of loose shelves or drawers designed to be inserted into a frame having at least four vertical uprights, each upright having adjacent side walls defining a generally V-shaped vertical portion with a vertical vertex line and a series of vertically spaced hook-shaped cutouts therein for supporting the shelves or drawers.

9 Claims, 12 Drawing Figures

SHELVING SYSTEM AND ITS PRODUCTION PROCEDURE

This is a continuation of application Ser. No. 76,183, filed Sept. 17, 1979.

BACKGROUND OF THE INVENTION

This invention concerns a shelving system of the type consisting of loose shelves or drawers designed to be inserted into a frame in which hook-shaped parts have been designed for supporting the shelves or the drawers.

In the case of such known shelving systems the hooks constitute parts which have been made separately, and each has been attached to vertical uprights. In the case of the production and the assembly of the known systems, a large amount of time is used for the production and the mounting of the hooks, and the uprights will also have to be prepared for the mounting.

The purpose of the present invention is a shelving system of simpler design than that of the known systems, requiring a minimum of labour for production.

BRIEF DESCRIPTION OF THE INVENTION

The shelving system of the invention is characterized in that the hook-shaped parts have been designed as cutouts in vertical uprights, consisting of plate material deformed into a cylindrical or a prismatic shape, however, not necessarily a closed cylindrical or prismatic shape.

A very simple plate design is disclosed, which is easy to produce having a highly uniform load distribution, and requiring minimum section dimensions. The individual uprights will only be exposed to vertical forces lying within the section. No moments will be transferred using the hook-shaped cutouts.

One mode of design of this shelving system is characterized in that the cutouts in an upright have been shaped symmetrically around a vertical bending M-edge protruding outwards from the section of the upright. Thus, the bending strength of the hook-shaped part will be increased considerably.

Another mode of design is characterized in that a shelf or a drawer at the longitudinal sides has been designed with downward-protruding edges the height of which have been adapted to the height of the cutouts so that the shelf or the drawer may be removed from mesh with an upright by lifting and movement away from same or vice versa, the horizontal distance between the downward-protruding edges of the shelf or of the drawer having been adapted to the distance between the uprights of the frame, and the height of the downward-protruding edges. the cutouts including the hook-shaped parts having been adapted to each other in a manner to ensure that the downward-protruding edges at the mesh position will rest at the bottom of the hook-shaped cutouts.

The design is easy to work with in the case of frames which require the exchange of shelves or drawers to a considerable extent. Thus, it is convenient to be able to shift the shelves or the drawers longitudinally as they slide into the supports and then lift them sideways out of these at some of the supports. The shelving system may be given such small dimensions that the parts will be very elastic in relation to each other. When the downward-protruding edges at the mesh position rest at the bottom of the hook-shaped cutouts, you will obtain a highly advantageous distribution of the vertical forces in the upright which has been loaded like a column with vertical forces working virtually at the middle of the section. This allows for obtaining and permitting the elasticity referred to.

A further development of this mode of design is characterized in that the downward-protruding edges at a shelf or a drawer stretch around the corners of the shelf or the drawer, and in that an upright has been placed close to each corner.

When the downward-protruding edges stretch around the corners, you obtain firstly that the drawers or the shelves will not slide out by themselves but secondly you do in fact get a bracing of the uprights which are prevented by the drawers or by the shelves from deflection by column effect.

Another further development of the latter mode of design is characterized in that it has a shelf, shaped from plate material bent at the edges into a reversed channel section, there being at each corner cutouts stretching in above the limitation of the channel section, and band-shaped reinforcements having been attached at the inside of the outermost flanges of the channel section, i.e. along the shelf edge, at least at the corners, these reinforcements being for instance spot welded band material for ming detached angles at the shelf corner cutouts and designed to mesh with uprights placed at the corners of the shelf. This shelf design is very easy, and it consists of very few parts which may be produced by a machine, and which possess strength in places requiring strength. If the shelves are square viewed from above, it will make no difference whether you insert them along one or the other side.

A third further development of the latter mode of design is characterized in that it has a shelf designed from plate material, bent at the edges into a reversed channel section, there being at each corner cutouts, and band-shaped reinforcements having been attached at the inside of the outermost flanges in the channel section, i.e. along the shelf edge, at least at the corners, these reinforcements being for instance spot welded band material forming detached angles at the shelf corner cutouts and having been designed to mesh with uprights placed at the corners of the shelf but where the two channel sections lying in the insertion direction, i.e. along the side edges of the shelf, end at a longer distance from the corners than that of the two transverse channel sections.

This design is expedient in that it has rectangular shelves. The unsymmetrical corners will add to the area of the drawers or of the shelves in the insertion direction, and you will then be able to utilize the area established by the vertical uprights in a better manner.

To this invention, the uprights may have a mainly quadratic section which, however, is short of the corner lying diagonally opposite the cutouts. Thus, you will get a design having a suitably good resisting moment, i.e. offering adequate rigidity against deflection by column effect, and at the same time the uprights are very easy to produce since for instance merely a punching operation and a bending operation are required, i.e. operations requiring a high degree of automation.

Finally, the shelving system may be characterized in that the dimensions have been thus adapted to each other that a shelf in its supported horizontal position will have considerable play in the insertion direction.

Thus, it will be possible to hook drawers or-shelves on to the uprights at an inclined position, assuming that there will be a suitably small vertical distance between the hook-shaped cutouts in the vertical direction. This may come into the picture if you use the shelving system for display purposes.

This invention also concerns a procedure for the production of uprights for a shelving system to the invention, and this procedure is characterized in that you shape the cutouts, for instance by punching, in a level plate material blank, and in that you will then deform the plate material into the cylindrical or the prismatic shape, for instance by bending. In this connection, we have, as mentioned above, pointed to a rational procedure which may be highly automatized.

BRIEF DESCRIPTION OF THE DRAWINGS

The invention is explained further with reference to the drawing where.

DETAILED DESCRIPTION OF THE DRAWINGS

Figure 1:
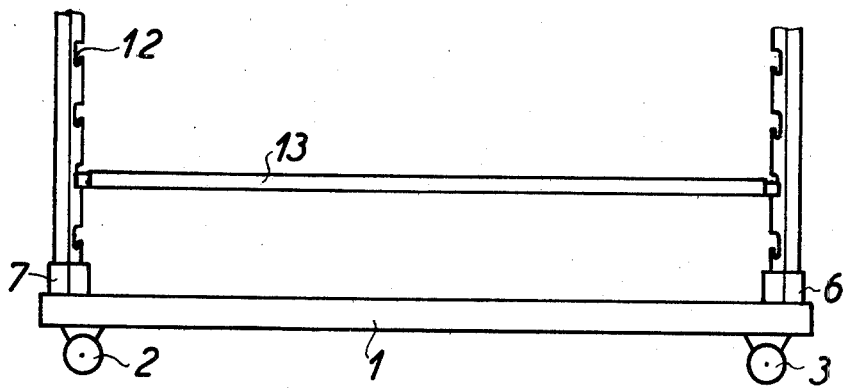
FIG. 1 shows parts for a shelving system to a mode of design of the invention viewed from in front, FIG. 2 the same thing viewed from above, FIG. 3 part of an upright for the shelving system on an enlarged scale viewed against a carving, FIG. 4 the same thing viewed from the side, FIG. 5 a section to the line V—V in FIGS. 3 and 4, FIG. 6 a section viewed from above of a corner of a shelf to a mode of design to the invention in connection with a mode of design of an upright to the invention, viewed in section, FIG. 7 a section to the line VII—VII of FIG. 6, FIG. 8 the same as in FIG. 6 but to another mode of design of the shelf, FIGS. 9–11 horizontal sections in various modes of design of uprights, and FIG. 12 the same as in FIG. 6 but to a third mode of design.
Figure 2:
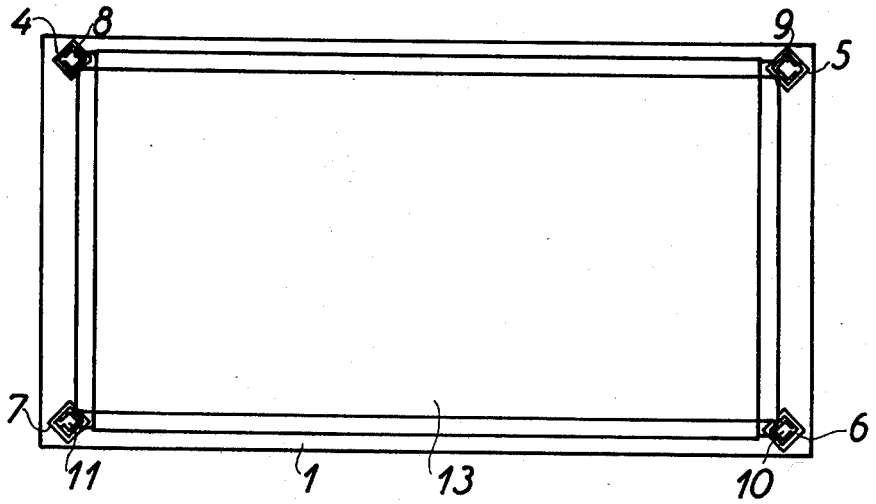

In FIGS. 1 and 2, a carriage 1 has been shown, consisting of a rectangular plane, base plate or frame with four wheels 2 and 3 of which some may be pivotable. At the upper side the carriage 1 has been designed at the corners to have four quadratic sockets or sleeves 4, 5, 6, and 7, intended to support four vertical uprights 8, 9, 10, and 11. In these uprights, hook-shaped parts 12 have been shaped, designed to support shelves 13 such as will be explained further below.

Figure 3:
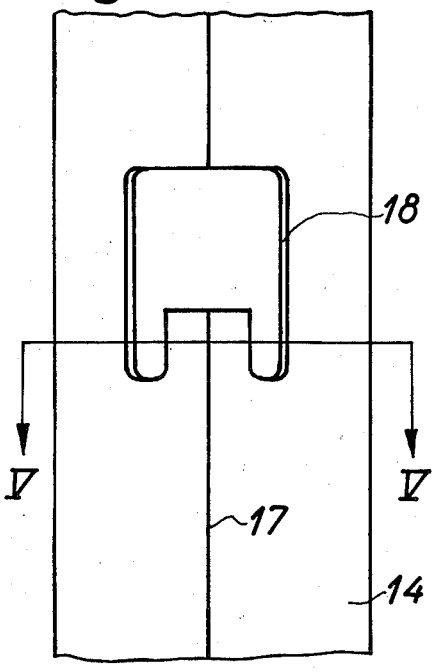
Figure 4:
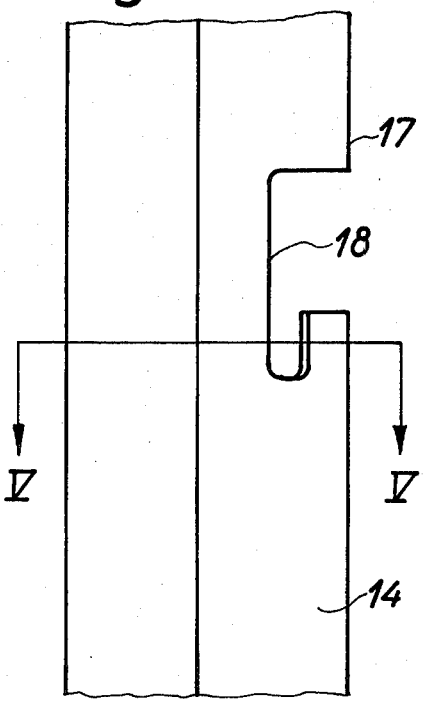
Figure 5:
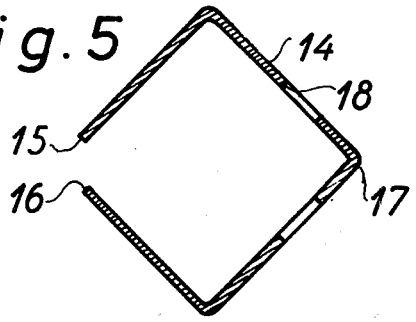

FIGS. 3, 4, and 5 show part of an upright 14, viewed double-right-angled, and having a mainly quadratic section. The upright has been bent from plate material and has not been assembled into an enclosed section, the edges 15 and 16 adjoining one of the corners of the quadratic section. At the diagonally viewed opposite corner or the opposite edge 17, a hook-shaped cutout 18 has been shaped, corresponding to the hook-shaped parts 12 in FIG. 1.

Figure 6:
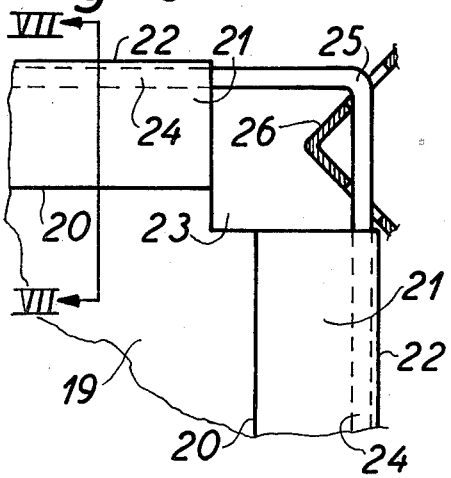
Figure 7:
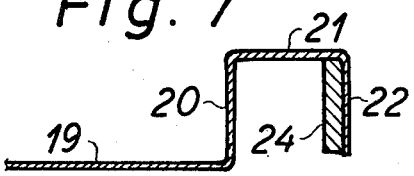

FIGS. 6 and 7 show a corner of a shelf, built up from plate material, consisting of a level part 19, bent at the edges into a reversed channel section, i.e. with three flanges 20, 21, and 22. At the shelf corner a carving 23 has been shaped, stretching in above the channel sections, i.e. these sections do not in any way reach each other. This provides two advantages. First, it is easier to bend the edges into channel sections, and secondly it is a simple matter to insert a reinforcement in the form of a band material 24 which is attached, for instance by spot welding at even distance, along the inside of the flange 22. This band material 24 runs along a rectangle determined by the flange 22, i.e. the band material lies freely and forms a corner 25 for the shelf at the cutouts 23. Thus, it may at the same time serve to mesh with a hook-shaped part 26 as shown in FIG. 6. As would readily appear from FIG. 6, the corner 25 in connection with the hook-shaped part 26 will create a stop for relative movement of the two parts in relation to each other, i.e. if for instance the corner 25 is moved downward on the paper, and the hook-shaped part 26 is stationary whereas a movement the opposite way will run freely, i.e. by sliding between the parts.

Figure 8:
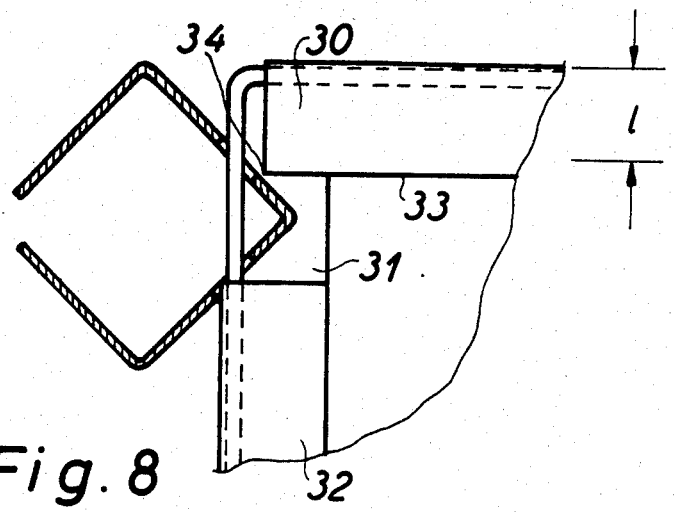

FIG. 8 shows another design corresponding to FIG. 6 where one channel section 30 has been carried further into a cutout 31 than has the adjoining channel section 32. Thus, the shelf has become longer by the distance 1 as shown using the same upright type having a mainly quadratic section. The inner flange 33 of the channel section 30 has been carried up to the corner 34 and thus constitutes a stop bearing against the hook-shaped part. Obviously, one may imagine many other modes of design of drawers or shelves to the invention.

Figure 9:
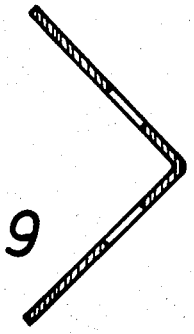
Figure 10:
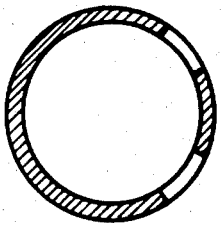
Figure 11:
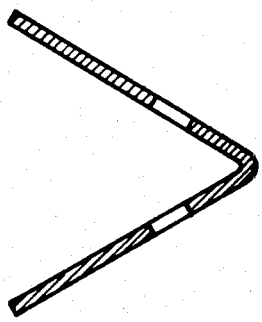

FIGS. 9, 10, and 11 show other possible modes of design for uprights. FIG. 9 shows an upright having an L section where the vertical load may be brought to go through the section centre of gravity, and which is very simple to produce. Of course, the cutouts forming the hook-shaped parts are shaped in a level blank and then the blanks are bent. For this, the mode of design to FIG. 10 is not suitable. The tubular section is, as you would know, the section most highly suitable for column load, and the cutouts in this will have to be made in a tubular blank; for instance, you may produce the cutouts automatically by means of laser beams.

FIG. 8 shows a mode of design corresponding to the one shown in FIG. 9 but the hook-shaped part will only be somewhat stronger, i.e. it will have a larger resisting moment the more pointed the angle. The design of the hook-shaped part may, of course, be varied in all sorts of ways within the framework of the present invention. The decisive point is that the hook-shaped part is produced by shaping a cutout in a plate material, and that the load on the hook-shaped parts will lie within the column section.

The support for the uprights constitutes no part of the present invention. The support shown in FIG. 1 in the form of a carriage may, of course, as well be that of a stationary support. In the case of certain applications, it may prove expedient to support the upper ends of the uprights by means of a control plate or a control frame which from above has been designed to mesh with the upper ends of the uprights and secure them against reciprocal horizontal movements.

Finally, it should be stressed that by cylindrical shape as stated in the main claim you need not necessarily understand circular-cylindrical.

Figure 12:
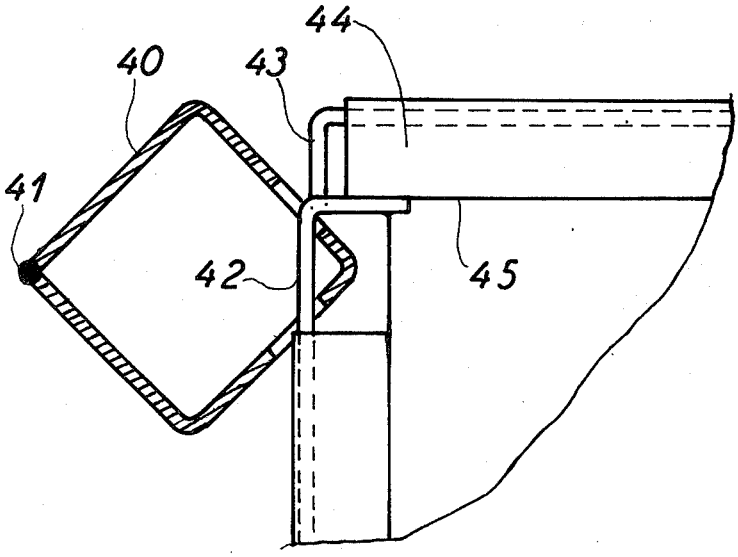

FIG. 12 shows an upright 40 having a section closed by a welded seam 41. This welded seam 41 need not, however, be through-going through the length of the upright. As you would know, fastening the parts together at regular intervals will actually provide a substantial increase in the strength. The corner of the shelf shown in FIG. 12 also represents another mode of design which does not necessarily belong with the special design of the upright 40 in FIG. 12. The band-shaped reinforcement has thus been divided into two band-shaped reinforcements 42 and 43 out of which the former has been bent to bear against the inner flange 45 of the channel section 44 whereas the latter has been bent so that the end bears against the corner of the former. At this spot, it may be welded. The bent part of the former band-shaped reinforcement 42 will, as shown, form a stop for the shelf when engaging the upright.

The bent part of the other band-shaped reinforcement 43 may also engage the upright if you require the shelf placed in an inclined position, and if the distances between the parts to be engaged have been adapted to each other. The band-shaped reinforcements may stretch round along the entire shelf edge but they need not do so for they may for instance be confined to being corner reinforcements.

I claim:

1. A rack for detachably mounting shelf members which may be moved horizontally into and out of an assembled position, said members having two vertical parallel side wall edge portions, said rack comprising at least four vertical uprights, each upright having adjacent side walls defining a generally V-shaped vertical portion with a vertical vertex line and a series of vertically spaced hook-shaped cutouts therein, each cutout being symmetrically disposed about the vertex line of said V-shaped portion and having a vertically oriented notch in each of said side walls, for receiving and supporting part of said vertical side wall edge portion of a shelf member to be mounted to said rack, a first pair of said uprights being disposed so that all four notches thereof are in a straight line parallel to one of said side wall edge portions, and a second pair of said uprights being disposed so that all four notches thereof are in a straight line parallel to the other of said side wall edge portions, whereby said notches act as glides for said members shelf members so that each shelf members can slide into and out of said rack but, once in the rack is held in said assembled position.

2. The rack of claim 1 wherein at least one vertical upright has a prismatic shape.

3. The rack of claim 1 wherein the vertical upright has a four sided prismatic shape which is open at the corner opposite said vertex.

4. The rack of claim 1 wherein at least one vertical upright is in the shape of a vertical cylinder.

5. The rack of claim 1 or 2 wherein said uprights are mounted on a rectangular base at the corners thereof with said vertices being rotated at an oblique angle with respect to the corners of said base.

6. The rack of claim 5 wherein said oblique angle is about 45°.

7. A process for making the uprights for the shelving rack of claim 1 which comprises:

(1) forming a symmetrical hooked shaped cutout in a flat piece of metal;

(2) bending the flat piece of metal to form a vertical upright having a hook shaped cutout, shaped symmetrically about a surface protruding outward from a portion of the upright.

8. The process of claim 7 wherein the flat plate is bent to form a protruding surface which is a vertical edge passing through the cutout.

9. The process of claim 7 or 8 wherein the hook shaped cutout is punched in the metal plate.

* * * * *